US010807261B2

(12) United States Patent
Zaremba et al.

(10) Patent No.: US 10,807,261 B2
(45) Date of Patent: Oct. 20, 2020

(54) RAZOR HANDLE

(71) Applicant: Harry's, Inc., New York, NY (US)

(72) Inventors: Francis Zaremba, Brooklyn, NY (US); Michael Chad Makay, Santa Clara, CA (US); Robert Angelo Riccomini, Saratoga, CA (US)

(73) Assignee: Harry's, Inc., New York, NY (US)

( * ) Notice: Subject to any disclaimer, the term of this patent is extended or adjusted under 35 U.S.C. 154(b) by 0 days.

(21) Appl. No.: 16/012,461

(22) Filed: Jun. 19, 2018

(65) Prior Publication Data

US 2018/0370052 A1 Dec. 27, 2018

Related U.S. Application Data

(60) Provisional application No. 62/523,046, filed on Jun. 21, 2017.

(51) Int. Cl.
*B26B 21/52* (2006.01)
*B26B 21/14* (2006.01)
(Continued)

(52) U.S. Cl.
CPC ..... *B26B 21/528* (2013.01); *B26B 21/14* (2013.01); *B26B 21/4062* (2013.01);
(Continued)

(58) Field of Classification Search
CPC ..... B26B 21/528; B26B 21/52; B26B 21/521; B26B 21/522; B26B 21/523–525;
(Continued)

(56) References Cited

U.S. PATENT DOCUMENTS 371,297 A * 10/1887 Becker ..... B25G 3/26 403/378
1,442,548 A * 1/1923 Whitfield ..... B25G 3/26 76/114
(Continued)

FOREIGN PATENT DOCUMENTS

CA 2447158 C 1/2005
CA 2557281 C 7/2010
(Continued)

*Primary Examiner* — Evan H MacFarlane
(74) *Attorney, Agent, or Firm* — Florek & Endres PLLC

(57) ABSTRACT

A razor handle including a hollow, elongated gripping member having an open end, a second end and an intermediate opening, a cartridge connection member having a first end adapted to retain a razor cartridge and a second end forming an insert having a receiver, and a fastener adapted to pass through the intermediate opening of the gripping member and engage the receiver on the insert to securely retain the cartridge connection member on the gripping member.

Also, a method of manufacturing a razor handle including inserting an insert of a cartridge connection member into an open end of a gripping member, passing a stem member of the fastener through an intermediate opening of the gripping portion, and securing the stem of the fastener to the cartridge connection member to retain the cartridge connection member on the gripping portion.

15 Claims, 7 Drawing Sheets

(51) Int. Cl.
*B26B 21/40* (2006.01)
*B25G 3/26* (2006.01)
*B26B 19/38* (2006.01)

(52) U.S. Cl.
CPC ..... *B26B 21/521* (2013.01); *B26B 21/522* (2013.01); *B25G 3/26* (2013.01); *B26B 19/3853* (2013.01)

(58) Field of Classification Search
CPC ..... B26B 1/10; B26B 19/3853; B26B 19/386; B26B 21/14; B26B 21/4062; B25G 3/26; B25G 1/00; B25G 1/10; B25G 1/102; B25G 3/00; B25G 3/02; B25G 3/12; B25G 3/14; B25G 3/24; B25G 3/28; B25G 3/36
USPC ..... 30/526, FOR. 100, 101, 102, 103, 104, 30/527–536, 47–51, 340–344; 16/110.1, 16/111.1, 412–430; 403/378, 379.1, 403/379.2, 379.3, 408.1
See application file for complete search history.

(56) References Cited

U.S. PATENT DOCUMENTS 1,511,434 A * 10/1924 Thomson ..... B25B 15/02 81/177.1
1,849,299 A * 3/1932 Emerson ..... B26B 21/30 30/51
1,968,463 A * 7/1934 Mobley ..... B25G 3/26 279/97
3,358,368 A * 12/1967 Kuhnl ..... B26B 21/32 30/41.7
3,363,312 A * 1/1968 Fayed ..... B26B 21/26 30/40.1
3,740,841 A * 6/1973 Risher ..... B26B 21/16 30/63
5,261,665 A * 11/1993 Downey ..... A63B 53/14 473/303
5,403,534 A * 4/1995 Kim ..... B26B 21/522 264/173.19
5,784,790 A 7/1998 Carson, III et al.
5,787,586 A 8/1998 Apprille, Jr. et al.
5,813,293 A * 9/1998 Apprille, Jr. ..... B26B 21/225 76/106
5,890,296 A * 4/1999 Metcalf ..... B26B 21/225 30/526
5,926,911 A * 7/1999 Chen ..... B25G 1/01 16/111.1
6,122,802 A * 9/2000 Lo ..... B25G 1/00 16/431
6,192,586 B1 2/2001 Metcalf et al.
6,370,783 B1 * 4/2002 Bozikis ..... B26B 21/52 15/167.1
6,619,408 B1 * 9/2003 Lai ..... B25G 1/01 16/110.1
6,880,253 B1 4/2005 Gyllerstrom
7,065,882 B2 * 6/2006 Haberstroh ..... A47J 17/02 30/143
7,163,466 B1 * 1/2007 Downey ..... A63B 60/00 473/300
7,168,173 B2 1/2007 Worrick, III
7,219,430 B2 5/2007 Fandrey et al.
7,500,313 B2 3/2009 Fandrey et al.
7,975,389 B2 * 7/2011 Bozikis ..... B26B 21/528 30/32
8,079,147 B2 12/2011 Wonderley
8,151,472 B2 4/2012 Dimitris et al.
8,590,162 B2 * 11/2013 Park ..... B26B 21/225 30/50
8,671,577 B2 3/2014 Brown
8,793,880 B2 8/2014 Taub et al.
8,844,145 B2 9/2014 Psimadas et al.
8,984,756 B2 3/2015 Worrick, III
9,095,986 B2 8/2015 Psimadas et al.
9,216,516 B2 12/2015 Rees et al.
9,533,424 B2 1/2017 Winter et al.
2004/0181953 A1 9/2004 Follo
2004/0239130 A1 * 12/2004 Heuel ..... A01B 1/222 294/57
2005/0198830 A1 * 9/2005 Walker ..... B26B 21/4068 30/50
2007/0180699 A1 * 8/2007 Psimadas ..... B26B 21/52 30/34.1
2008/0209743 A1 * 9/2008 Quintiliani ..... B26B 21/522 30/526
2009/0113730 A1 5/2009 Psimidas et al.
2010/0005669 A1 * 1/2010 Winter ..... B26B 21/521 30/526
2010/0205808 A1 8/2010 King
2010/0313426 A1 12/2010 Royle
2011/0030228 A1 * 2/2011 Rees ..... B26B 21/40 30/536
2012/0073149 A1 3/2012 Murgida et al.
2012/0102747 A1 5/2012 Wain
2013/0291390 A1 * 11/2013 Gajria ..... B26B 21/52 30/526
2015/0328788 A1 11/2015 Ren
2017/0252935 A1 * 9/2017 Martin ..... B26B 21/528
2018/0029213 A1 * 2/2018 Li ..... B25G 3/26
2018/0043550 A1 * 2/2018 Lu ..... B26B 21/222
2018/0272549 A1 * 9/2018 Son ..... B26B 21/52

FOREIGN PATENT DOCUMENTS

CA 2721016 C 2/2014
CA 2720780 C 6/2014
CA 2730832 C 3/2015
CA 2970625 A1 6/2016
CA 2970634 A1 6/2016
CA 2970674 A1 6/2016
CA 2959258 A1 9/2017
EP 3318368 A1 5/2018
WO WO-2017086510 A1 * 5/2017 ..... B26B 21/08

* cited by examiner

RAZOR HANDLE

FIELD OF THE INVENTION

The present invention relates to the field of shaving razor handles and more particularly to the field of razor handles and methods of manufacture.

BACKGROUND OF THE INVENTION

Shaving razors have changed from straight edge razors, safety razors and disposable one-piece razors, having a unitary handle and shaving surface, to a handle and razor cartridge system, where the shaving surface is on a razor cartridge that is removably attached to a handle. Since these razor cartridges are removably attached to a handle, handles can be used through hundreds, if not thousands of cartridge replacements. This has allowed manufacturers to offer more significant, as well as higher cost, handles to the consumer.

Razor handles are, therefore, currently being made from multiple component parts. These may include weighted members to give the razor more substance in the user's hand, smooth portion near the razor cartridge for easier clean-up, and a gripping portion in the area where the user holds the razor. These component parts are in addition to the cartridge connection, which may be formed as an integral part of the handle or may be formed separately and attached to the remainder of the handle.

Incorporating different component parts has been achieved in different ways with different razor handles. In some, such as U.S. Pat. No. 5,813,293, a weighted member is placed within a hollow portion of an elongated cartridge support structure and gripping portions are fixed to the elongated cartridge support structure by attachment to the support structure and/or weighted member. In U.S. Pat. No. 5,890,296, the weighted member is fashioned in the form of a frame and gripping portions are attached directly to the frame.

Gripping members have also been incorporated onto handles in a variety of ways. In U.S. Pat. No. 5,890,296, gripping portions are attached to an elongated cartridge support member. In U.S. Pat. No. 9,533,424, a method of manufacturing a razor handle describes inserting a hollow inner sleeve with one or more gripping members on the exterior into a hollow outer shell with one or more openings, so the gripping portions protrude through the openings in the outer shell.

The prior art, however, is limited to the use of gripping portions on a handle with a separate cartridge connector portion. In keeping, the present invention is directed to a handle that overcomes the deficiencies of the prior art, providing a simple, easily manufactured handle with a cartridge connection portion and a distinct gripping portion.

SUMMARY OF THE INVENTION

The present invention is directed to a razor handle and method of manufacture. The razor handle comprises a hollow elongated gripping member having an open end, a second end and an intermediate opening, a cartridge connection member comprising a first end adapted to retain a razor cartridge and a second end forming an insert, and a fastener adapted to pass through the intermediate opening of the gripping member and engage the insert to securely retain the cartridge connection member on the gripping member.

In a preferred embodiment, the gripping member is formed of a rigid support, comprising a metal, hard plastic or the like, and an elastomeric material, such as TPE or the like, gripping surface. The gripping surface is preferably applied directly on at least a portion of the rigid support, and is preferably applied over the entire outer surface of the rigid support.

In addition to the improved grip characteristics of the elastomeric material applied to the rigid support, the gripping surface also preferably comprises areas with textured elements, such as raises, depressions, gnarling and/or combinations thereof that further improve the user's grip on the razor handle.

The second end of the gripping member is preferably closed, but can be open. In an embodiment, the open end could be sealed, including with a sealing member, such as a cap, cover, closure, or the like to prevent water and/or debris from entering the gripping member through the opening.

The rigid support of the gripping member preferably comprises a keyway, in the form of a cut-out, channel or the like, to align the insert of the cartridge connection member in the rigid support of the gripping member. Preferably, the keyway is formed interior to the support, so that the key or keyway is not seen on the exterior of the finished handle, and runs along a majority of the rigid support to improve the stability of the connection between the cartridge connection member and the gripping member.

The cartridge connection member is preferably formed of a rigid material, such as a metal, a plastic or a combination of materials, and is preferably a die cast metal or an acrylonitrile butadiene styrene ("ABS") plastic. The first end of the cartridge connection member comprises a cartridge connection portion. The cartridge connection portion comprises structure that forms a part of the cartridge connector for retaining a razor cartridge, or otherwise comprises a support member that is adapted to couple a cartridge connector subassembly to the cartridge connection member for retaining a razor cartridge to the cartridge connection member.

The second end of the cartridge connection member comprises an insert with a receiver, preferably in the form of an aperture, which cooperates with the fastener to fix the fastener to the insert. In the preferred embodiment, the insert also comprises a key, rib or the like, that is adapted to cooperate with the keyway of the rigid support of the preferred gripping member.

The fastener preferably comprises a head having an enlarged upper surface and one or more deflectable stem portions extending below the head, where one or more of the stem portions have a locking tab at or near a terminal end. The head of the fastener fits within, on or over the intermediate opening with the upper surface, being visible on the outer surface of the gripping member, while the locking tabs on the deflectable stem portions snap fit into the aperture on the preferred insert to lock the gripping portion on the cartridge connection portion. Additional stem portions may be used to properly fit the receiver of the insert.

The fastener can be made of any rigid or semi-rigid material, and preferably a plastic, with an ABS plastic being found to be suitable for use in the attachment to the insert. In the preferred embodiment, the entire fastener is made of plastic, however, a coating, indicia or the like may be placed on the outer surface of the head of the fastener, if desired.

It is also preferred that the intermediate opening on the gripping member is located closer to the second end of the gripping member. Accordingly, the receiver is located at a position that extends farther within the gripping member, to align with the intermediate opening. This placement provides additional stability of the cartridge connection member on the gripping member, since there is more surface contact between the insert and the interior of the gripping member.

During manufacture of the preferred embodiment, the insert of the cartridge connection member is inserted into the open end of the gripping member, with the key of the insert sliding within the keyway of the rigid support to align the cartridge connection member on the gripping member. Once fully inserted, where the receiver on the insert is lined up with the intermediate opening on the gripping member, the stem portions of the fastener are passed through the intermediate opening and the head of the fastener is pressed down to create a snap fit between the locking tabs at the ends of the stem portions and the receiver of the insert.

BRIEF DESCRIPTION OF THE DRAWINGS

The present invention will be better understood when considered in view of the attached drawings, in which like reference characters indicate like parts. The drawings, however, are presented merely to illustrate the preferred embodiment of the invention without limiting the invention in any manner whatsoever.

DETAILED DESCRIPTION OF THE PREFERRED EMBODIMENT

Figure 1A:
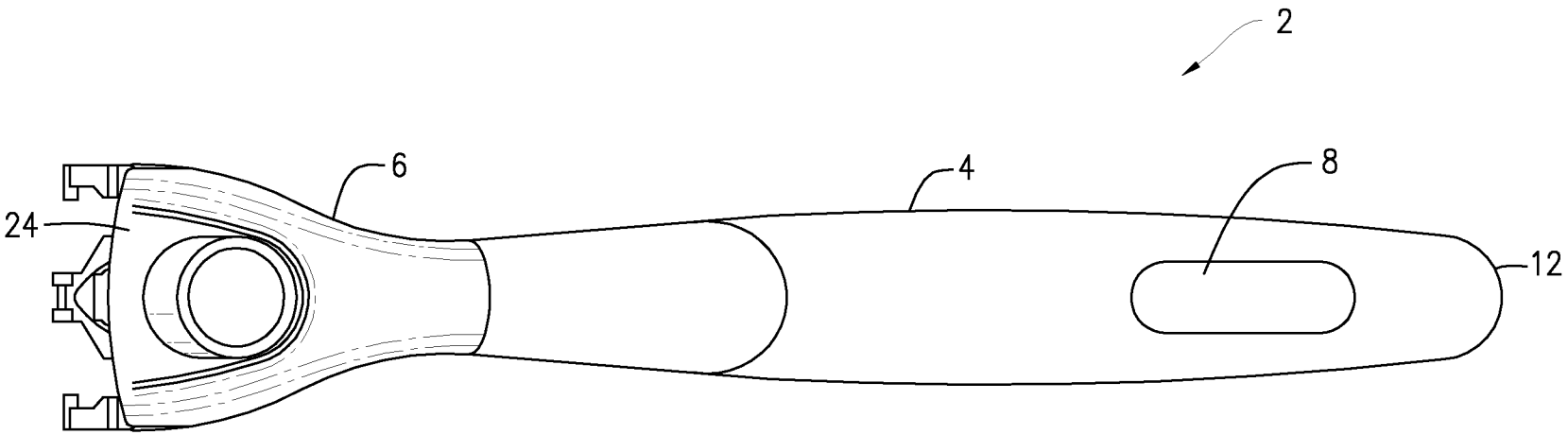
FIG. 1A is a top plan view of a preferred razor handle of the present invention.
Figure 1B:
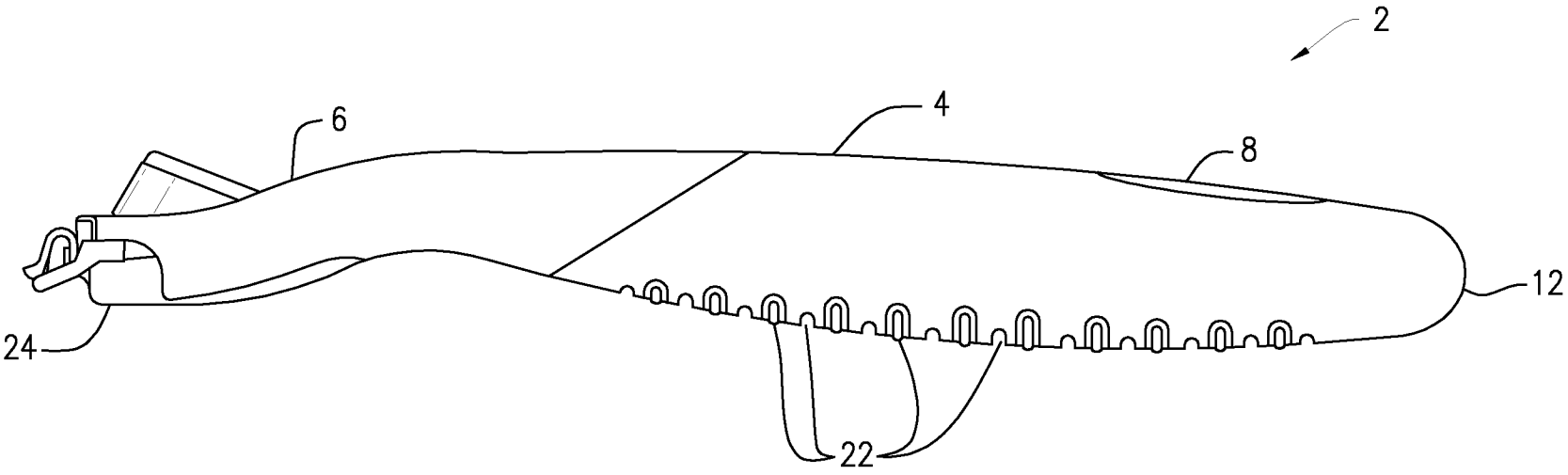
FIG. 1B is a side elevation view of a preferred razor handle of the present invention.
Figure 1C:
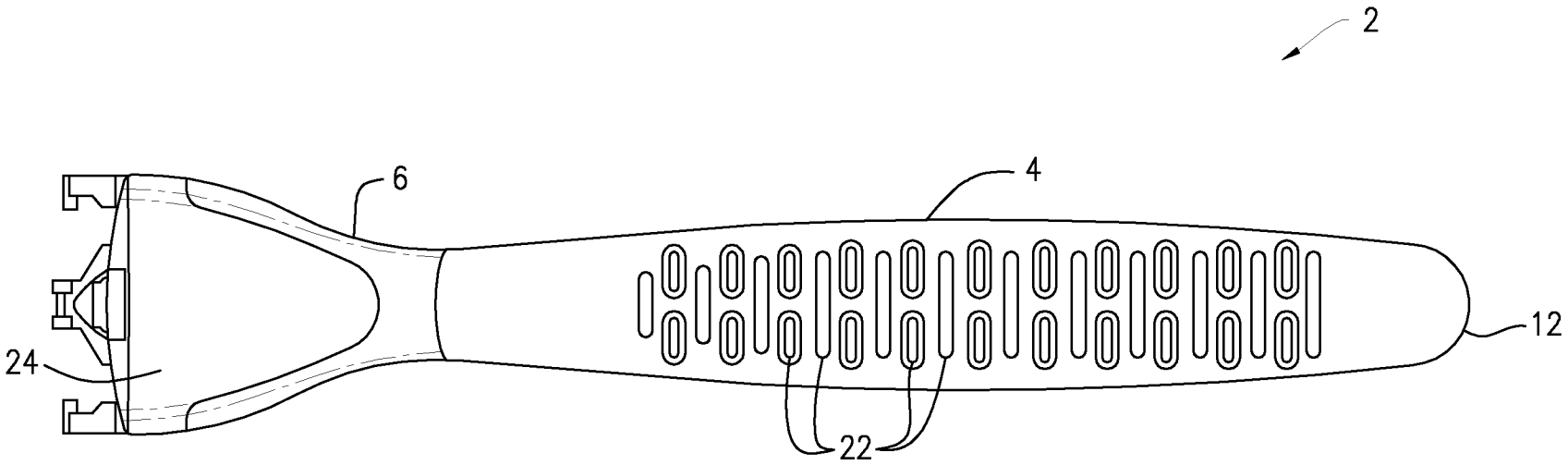
FIG. 1C is a bottom plan view of a preferred razor handle of the present invention.
Figure 2:
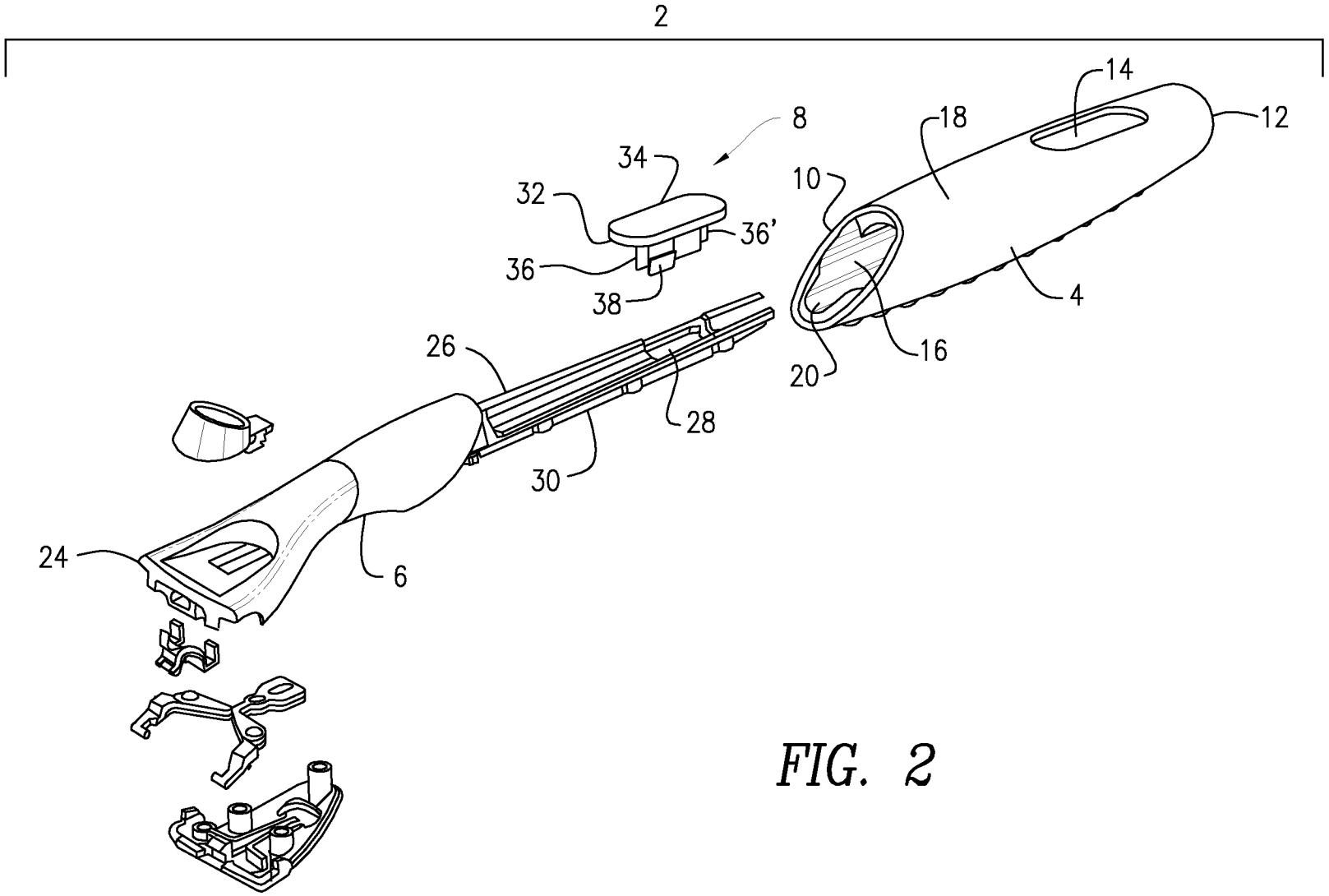
FIG. 2 is an exploded view of a preferred razor handle of the present invention.

The preferred embodiment of the razor handle 2 of the present invention shown in FIGS. 1A-1C comprises a hollow elongated gripping member 4, a cartridge connection member 6 and a fastener 8 for fixing the cartridge connection member 6 to the gripping member 4.

As more fully shown in FIG. 2 and FIGS. 3A-3C, the preferred gripping member 4 comprises an open end 10, a closed second end 12 and an intermediate opening 14. The preferred gripping member 4 is formed of a rigid support 16 with a gripping surface 18 covering the exterior surface of the rigid support 16. As such, the rigid support 16 generally comprises the shape of the gripping member 4. The rigid support 16 also includes a keyway 20, preferably in the form of channel within an interior wall of the rigid support 16, to align the cartridge connection member 6 within the gripping member 4.

The gripping surface 18 of the gripping member 4 preferably comprises an elastomeric material, and most preferably a TPE, applied directly on the rigid support 16 by an over-molding of the elastomeric material on the entire outer surface of the rigid support 16. The gripping surface 18 also preferably comprises areas with texture elements 22, including a pattern of raises and depressions to further improve the grip.

The preferred cartridge connection member 6 is formed of a rigid material, and most preferably a die cast metal or a plastic, such as ABS plastic, with a cartridge connection portion 24 at a first end and an insert member 26 at a second end. The cartridge connection portion 24 shown comprises structure that forms a part of the cartridge connector for retaining a razor cartridge, however, it is understood that the cartridge connection portion 24 can be any structure that is adapted to couple a cartridge connector or cartridge connector subassembly to the cartridge connection portion 24 for retaining a razor cartridge to the cartridge connection member 6.

The insert member 26 of the cartridge connection member 6 is adapted to fit securely within the gripping member 4, and preferably comprises a receiver or aperture 28 which cooperates with the fastener 8 to fix the fastener 8 to the insert member 26. The preferred insert member 26 shown also comprises a key 30, in the form of a rib on the insert member 26, which fits within the keyway 20 of the rigid support 16 of the preferred gripping member 4 to properly align the cartridge connection member 6 on the gripping member 4.

The preferred fastener 8 shown in the attached drawings comprises a head 32 with an enlarged upper surface 34 and a plurality of stem portions 36 extending below the head 32. The fastener 8 can be formed of any suitable material, with a rigid or semi-rigid material, such as a plastic and preferably an ABS plastic, being most preferred, to form at least a portion of the fastener 8.

In the preferred embodiment, a pair of stem portions 36 have opposed outwardly extending locking tabs 38 at the terminal ends where the stem portions 36 deflect to provide a snap fit connection with the aperture 28 of the insert member 26. In the preferred embodiment, connection of the locking tabs 38 within the aperture 28 creates a permanent connection, generally resulting in destruction of the fastener 8 if forcibly removed. The preferred fastener 8 shown in the drawings also includes additional stem portions 36' that do not have locking tabs, which are included to help position and fit the fastener 8 in the aperture 28.

Figure 3A:
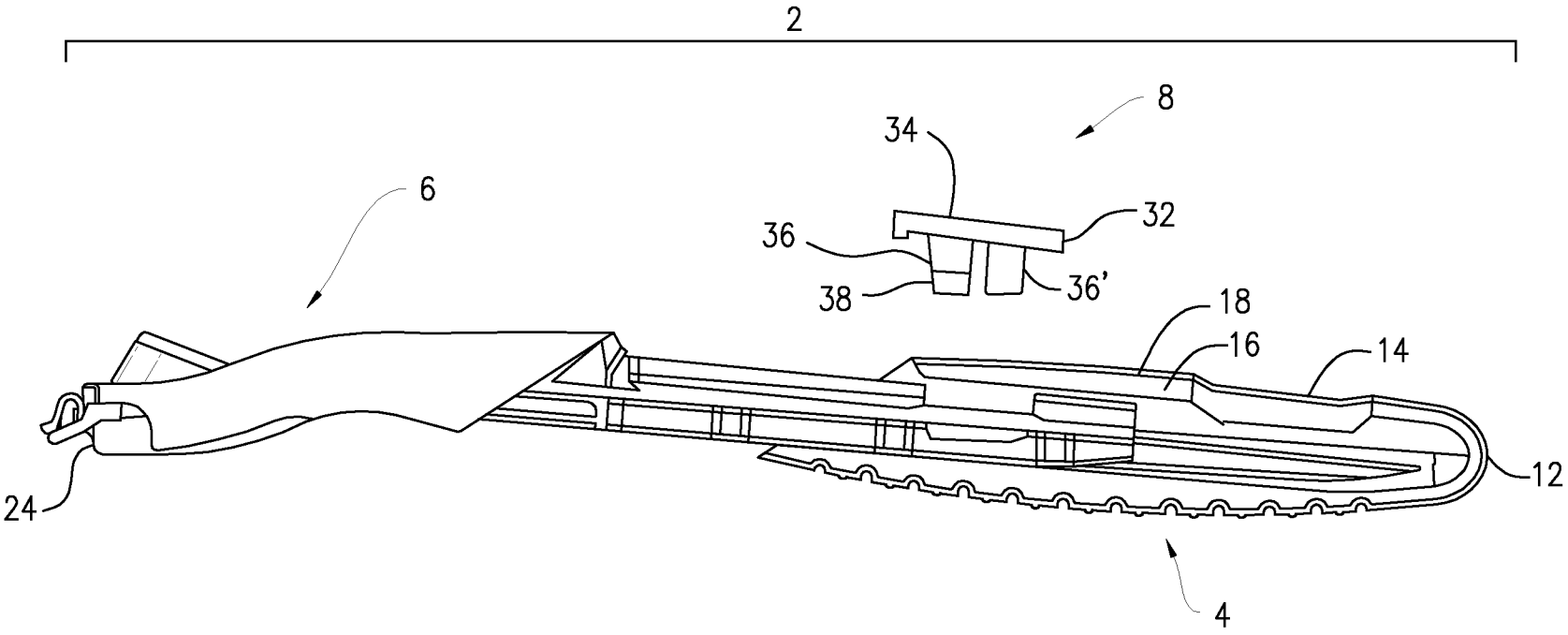
FIG. 3A is a first assembly schematic in partial cross section, showing the insert of the cartridge connection member being inserted into the gripping member.
Figure 3B:
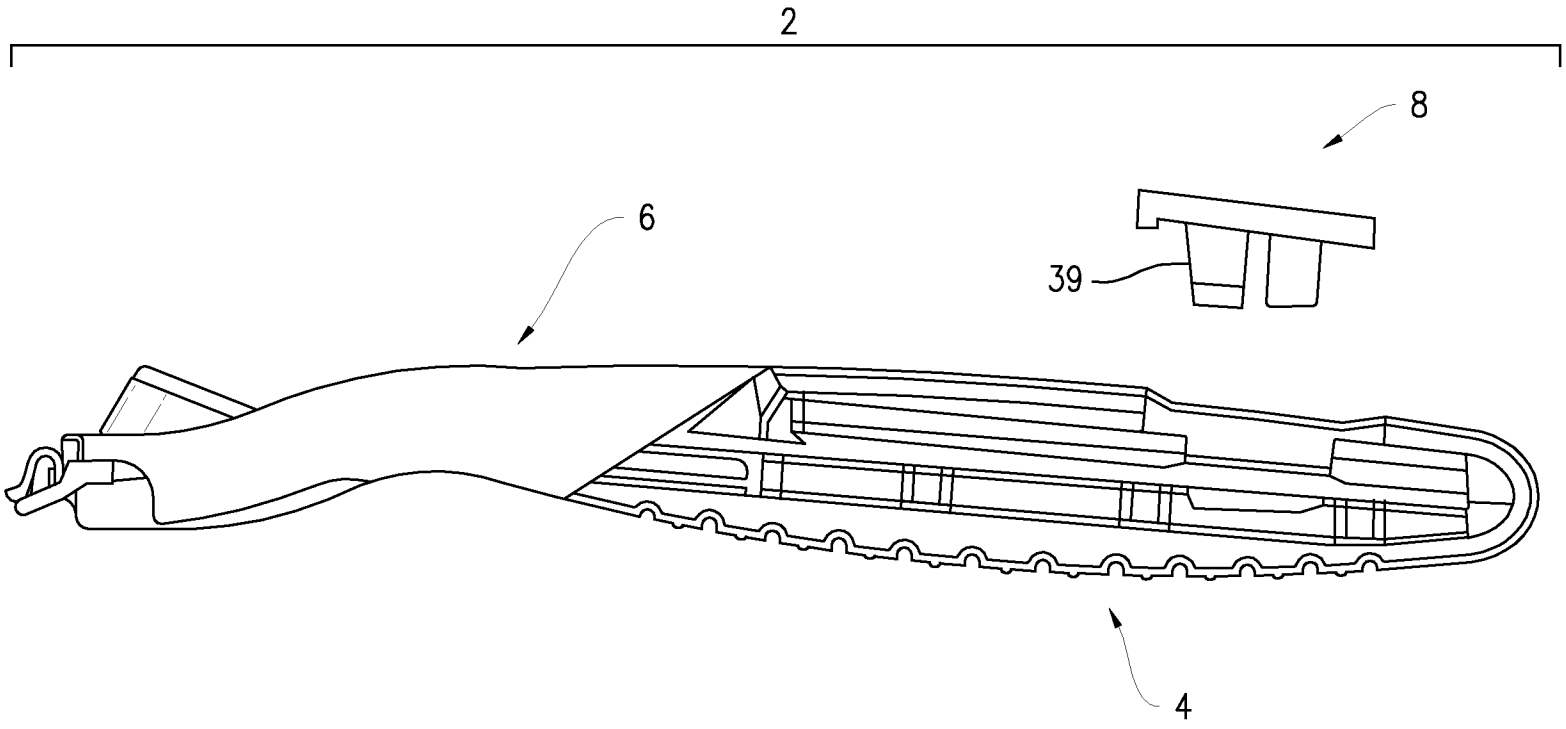
FIG. 3B is a second assembly schematic in partial cross section, showing the insert of the cartridge connection member fully inserted into the gripping member with the fastener prior to attachment.

Additionally, the preferred fastener 8 comprises a ramp 39, such as on the front face of the stem portion 36 (as shown in FIG. 3B), that acts against a corresponding portion of the perimeter of the intermediate opening 14, thereby forcing the opposed surface of the stem portion 36' against the perimeter of the aperture 28 to draw the cartridge connection member 6 into the gripping member 4 to ensure a tight fit.

The head 32 of the fastener 8 preferably fits within the intermediate opening 14 when fixed to the insert member 26, so that the upper surface 34 sits flush with or slightly below the exterior surface of the gripping member 4.

To help seat the head of the fastener 8 within the intermediate opening 14, the intermediate opening 14 may have a smaller exterior dimension than interior dimension. This may be a beveled or inwardly angled side wall, from the exterior of the gripping surface 18 to the interior of the rigid support 16, a shelf between the exterior of the gripping surface 18 and the interior of the rigid support 16, or any structure that permits the head 32 of the fastener 8 to fit securely within the intermediate opening 14. Similarly, the head 32 of the fastener 8 may have a corresponding angled side wall or shelf to securely fit the fastener 8 on or within the intermediate opening 14.

Additionally, the intermediate opening 14 on the gripping member 4 is located closer to the second end 12 of the gripping member 4 than to the open end 10. In keeping, the aperture 28 is located at a position on the insert member 26 that extends farther within the gripping member 4, to align with the intermediate opening. This provides additional stability between the cartridge connection member 6 and the gripping member 4.

Figure 3C:
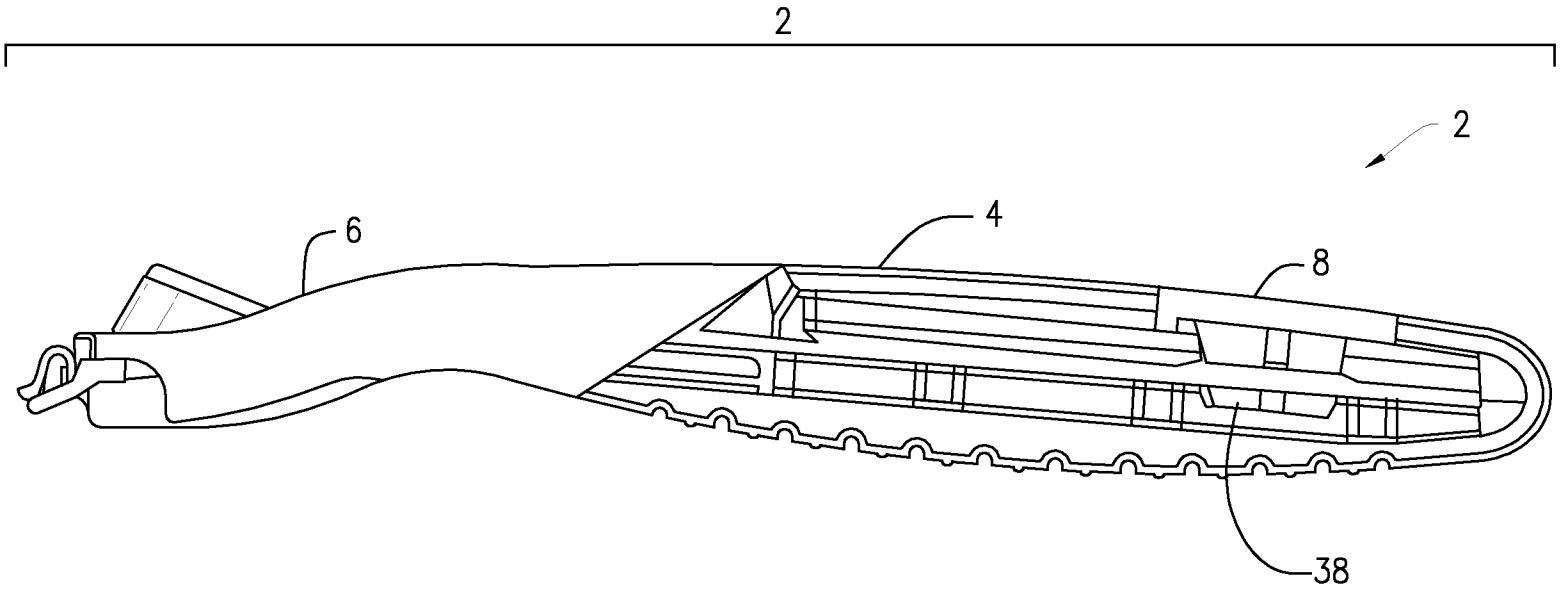
FIG. 3C is a third assembly schematic in partial cross section, showing the insert of the cartridge connection member fully inserted into the gripping member and the fastener attached to the cartridge connection member.

The razor handle 2 is preferably manufactured in a series of steps, generally shown in FIGS. 3A-3C. As shown in FIG. 3A, the insert member 26 of the cartridge connection member 6 is inserted into the open end 10 of the gripping member 4, with the key 30 of the insert member 26 sliding within the keyway 20 of the rigid support to align the cartridge connection member on the gripping member.

When the insert member 26 is fully inserted in the gripping member 4, as shown in FIG. 3B, the aperture 28 on the insert member 26 is lined up with the intermediate opening 14 on the gripping member 4, so that the stem portions 36 of the fastener 8 may be passed through the intermediate opening 14. The head 32 of the fastener 8 can then be pressed down to create a snap fit between the locking tabs 38 at the terminal ends of the stem portions 36 and the aperture 28 of the insert member 4, as shown in FIG. 3C.

Variations, modifications and alterations to the preferred embodiment of the present invention described above will make themselves apparent to those skilled in the art. All such changes are intended to fall within the spirit and scope of the present invention, limited solely by the appended claims.

Any and all patents and/or patent applications referred to herein are hereby incorporated by reference.

The invention claimed is:

1. A razor handle comprising:

an elongated gripping member having a first terminal end and a second terminal end opposite the first terminal end, said gripping member comprising a rigid support having a hollow portion, said gripping member further comprising an open end at the first terminal end, and an intermediate opening closer to the second terminal end than the first terminal end, and an elastomeric gripping surface overmolded onto an outer surface of the rigid support covering at least a portion of the outer surface of the rigid support, so that the gripping surface is integrally formed with the rigid support;

a cartridge connection member comprising a first end adapted to retain a razor cartridge and a second end forming an insert for insertion in the hollow portion of the gripping member at the open end of the gripping member, said insert comprising a receiver that aligns with the intermediate opening of the gripping member when the cartridge connection member is properly seated on the gripping member; and a fastener comprising a first end with at least one stem member adapted to pass through the intermediate opening of the gripping member and through the receiver on the insert to secure the cartridge connection member on the gripping member, wherein the at least one stem member comprises a locking tab for attachment directly to the insert.

2. The razor handle of claim 1 wherein the gripping member further comprises at least one of a keyway and a key and the cartridge connection member further comprises the other of a keyway and a key that cooperate to properly align the cartridge connection member with the gripping member.

3. The razor handle of claim 1 wherein the fastener comprises a surface to draw the cartridge connection member into the gripping member to secure the cartridge connection member to the gripping member.

4. The razor handle of claim 1 wherein the gripping surface comprises one or more areas having textured elements.

5. The razor handle of claim 1 wherein the rigid support comprises a plastic.

6. The razor handle of claim 1 wherein the elastomeric gripping surface comprises a thermoplastic elastomer (TPE).

7. The razor handle of claim 1 wherein the cartridge connection member comprises a rigid material.

8. The razor handle of claim 7 wherein the cartridge connection member comprises a material taken from the group consisting of a metal, a die cast metal, a plastic, an acrylonitrile butadiene styrene (ABS) and combinations thereof.

9. The razor handle of claim 1 wherein the receiver comprises an aperture in the insert of the cartridge connection member.

10. The razor handle of claim 1 wherein the fastener comprises a rigid or semi-rigid material.

11. The razor handle of claim 1 wherein the locking tab cooperates with the receiver on the cartridge connection member to lock the fastener to the cartridge connection member.

12. The razor handle of claim 1, wherein the at least one stem member of the fastener comprises two or more deflectable stems, a first one of the deflectable stems comprising the locking tab and a second one of the deflectable stems comprising an additional locking tab, the locking tabs cooperating with the receiver on the cartridge connection member to lock the fastener to the cartridge connection member.

13. The razor handle of claim 1 wherein the fastener further comprises a second end comprising a head for covering the intermediate opening when the fastener engages the insert of the cartridge connection member.

14. The razor handle of claim 13 wherein the head comprises an inner surface from which the at least one stem member extends and an outer surface that is visible on an exterior surface of the gripping member when the at least one stem member of the fastener engages the receiver of the cartridge connection member.

15. The razor handle of claim 14 wherein the head forms a watertight seal of the intermediate opening on the gripping member.

* * * * *